US012690620B2

(12) United States Patent
Cali et al.

(10) Patent No.: US 12,690,620 B2
(45) Date of Patent: Jul. 28, 2026

(54) DISPLAY FOR AN AEROSOL-GENERATING DEVICE

(71) Applicant: Philip Morris Products S.A., Neuchatel (CH)

(72) Inventors: Ricardo Cali, Mannheim (DE); Toney Moses Rajan, Mannheim (DE); Serge Lopez, Prades (FR)

(73) Assignee: Philip Morris Products S.A., Neuchatel (CH)

( * ) Notice: Subject to any disclaimer, the term of this patent is extended or adjusted under 35 U.S.C. 154(b) by 608 days.

(21) Appl. No.: 18/002,126

(22) PCT Filed: Jun. 24, 2021

(86) PCT No.: PCT/EP2021/067387
§ 371 (c)(1),
(2) Date: Dec. 16, 2022

(87) PCT Pub. No.: WO2021/260133
PCT Pub. Date: Dec. 30, 2021

(65) Prior Publication Data

US 2023/0218010 A1 Jul. 13, 2023

(30) Foreign Application Priority Data

Jun. 25, 2020 (EP) ..... 20182278

(51) Int. Cl.
*A24F 40/50* (2020.01)
*A24F 40/46* (2020.01)

(52) U.S. Cl.
CPC ..... *A24F 40/50* (2020.01); *A24F 40/46* (2020.01)

(58) Field of Classification Search
None
See application file for complete search history.

(56) References Cited

U.S. PATENT DOCUMENTS 9,451,791 B2 9/2016 Sears et al.
2007/0025673 A1* 2/2007 Bose ..... B82Y 10/00 385/129

(Continued)

FOREIGN PATENT DOCUMENTS

| | | | |
|---|---|---|---|
| CN | 105793642 | A | 7/2016 |
| CN | 111213086 | A | 5/2020 |
| JP | 2016-535304 | A | 11/2016 |
| JP | 2017-523550 | A | 8/2017 |
| JP | 2019-510489 | A | 4/2019 |
| JP | 2019-153590 | A | 9/2019 |

(Continued)

OTHER PUBLICATIONS

International Search Report issued Oct. 13, 2021 in PCT/EP2021/067387 filed on Jun. 24, 2021, citing documents 1-8, 15-16 & 23-25 therein, 5 pages.

(Continued)

*Primary Examiner* — Shan Liu
(74) *Attorney, Agent, or Firm* — Oblon, McClelland, Maier & Neustadt, L.L.P.

(57) ABSTRACT

A display is provided for an aerosol-generating device, the display including: a notification window; and a nano-photonic material extending over a front surface of the notification window, the nano-photonic material being configured to, in response to a light wave comprising at least one predetermined wavelength backlighting the notification window and being incident on the nano-photonic material, increase an amplitude of the at least one predetermined wavelength and emit therefrom a light wave comprising the at least one predetermined wavelength with the increased amplitude. An aerosol-generating device including the display is also provided.

14 Claims, 6 Drawing Sheets

(56) References Cited

U.S. PATENT DOCUMENTS

| | | | | |
|---|---|---|---|---|
| 2008/0315177 | A1 | 12/2008 | Bose et al. | |
| 2014/0098515 | A1 | 4/2014 | Pickett et al. | |
| 2015/0216233 | A1 | 8/2015 | Sears et al. | |
| 2016/0091757 | A1* | 3/2016 | Miki | G02F 1/133617 349/42 |
| 2016/0190403 | A1 | 6/2016 | Verschuuren et al. | |
| 2016/0216600 | A1 | 7/2016 | Hsu. et al. | |
| 2016/0260904 | A1 | 9/2016 | Park et al. | |
| 2016/0302488 | A1* | 10/2016 | Fernando | A24F 40/50 |
| 2017/0064996 | A1* | 3/2017 | Mironov | A24F 40/465 |
| 2017/0199149 | A1 | 7/2017 | Gundlach et al. | |
| 2017/0207370 | A1* | 7/2017 | Koole | H10H 20/8512 |
| 2017/0251724 | A1* | 9/2017 | Lamb | H05B 3/0014 |
| 2018/0348577 | A1 | 12/2018 | Pousthomis et al. | |
| 2019/0004369 | A1 | 1/2019 | Pousthomis et al. | |
| 2019/0004407 | A1 | 1/2019 | Pousthomis et al. | |
| 2019/0339447 | A1* | 11/2019 | Shipton | G02B 27/0081 |
| 2021/0181392 | A1 | 6/2021 | Lesuffleur et al. | |

FOREIGN PATENT DOCUMENTS

| | | | |
|---|---|---|---|
| KR | 2019/0049402 | A | 5/2019 |
| KR | 10-2020-0000635 | A | 1/2020 |
| WO | WO-2019/088577 | A2 | 5/2019 |
| WO | WO 2020/014064 | A1 | 1/2020 |

OTHER PUBLICATIONS

Written Opinion issued Oct. 13, 2021 in PCT/EP2021/067387 filed on Jun. 24, 2021, citing documents 1-3, 7-8, 15-16 & 23-25 therein, 8 pages.

Song et al., "Colors with plasmonic nanostructures: A full-spectrum review", Applied Physics Reviews, vol. 6, No. 4, Oct. 25, 2019, 25 pages.

Wen et al., "Color-Adjustable Devices Based on the Surface Plasmons Effect", Applied Sciences, vol. 10, No. 6, Mar. 13, 2020, 8 pages.

Gu et al., "Color generation via subwavelength plasmonic nanostructures", Nanoscale, vol. 7, No. 15, Jan. 1, 2015, 11 pages.

Gu et al., "Light-emitting diodes enhanced by localized surface plasmon resonance", Nano Research Letters, 6:199, 2011, 12 pages.

International Preliminary Report on Patentability issued Sep. 14, 2022 in PCT/EP2021/067367, citing document 1 therein, 14 pages.

Written Opinion of the International Searching Authority issued Jun. 3, 2022 in PCT/EP2021/067387, citing document 1 therein, 8 pages.

Extended European Search Report issued Jan. 12. 2021 In European Patent Application No. 20182278.0, 11 pages.

"Diffraction grating"—Wikipedia, Retrieved from the Internet https://en.wikipedia.org/wiki/Diffraction_grating, Apr. 27, 2020, 6 pages.

"Photonic crystal"—Wikipedia. Retrieved from the Internet https://en.wikipedia.org/wiki/Photonic_crystal, Apr. 27, 2020, 10 pages.

"Plasmonic nanoparticles"—Wikipedia, Retrieved from the Internet https://en.wikipedia.org/wiki/Plasmonic_nanoparticles, Apr. 27, 2020, 4 pages.

"Photon"—Wikipedia, Retrieved from the Internet, https://en.wikipedia.org/wiki/Photon, Apr. 27, 2020, 18 pages.

Japanese Office Action issued Jul. 28, 2025 in Japanese Patent Application No. 2022-577659 (with unedited computer-generated English translation), citing documents 15-19 therein, 7 pages.

Office Action and Search Report dated Jan. 31, 2026 issued in corresponding Chinese patent application No. 202180043207.5 (with English translation)(citing documents 1-5).

* cited by examiner

DISPLAY FOR AN AEROSOL-GENERATING DEVICE

The present disclosure relates to a display for an aerosol-generating device, and an aerosol-generating device incorporating such a display.

Known displays for aerosol-generating devices employ a light source within the device to illuminate a window of the display by backlighting the window with a light wave generated by the light source. It is known to impart different colours to the illuminated window with the light source to provide a user with an indication of the status of the device. For example, it is known to impart one or more desired colours to the backlit window by the use of a light source emitting light of one or more specific wavelengths corresponding to one or more desired colours. However, there is a problem with known displays in that the material of the window may impart an undesired change in the colour of the light from the light source as it passes through the window. This can be a particular problem when using a dead-front display, because the window of a dead-front display attenuates certain wavelengths of light. Such attenuation is commonly used to ensure that the colour of the window, when the display is in a non-operational state, corresponds to the colour of the device of which the display forms part. However, when the window is backlit by a light source within the device, this attenuation characteristic may impart an undesired tint to the illuminated window.

There is therefore a need for a display providing improved control of colour.

As used herein, the term "light" refers to emissions of electromagnetic radiation which are in the visible range of the electromagnetic spectrum, which is generally understood to encompass wavelengths in a range of about 380 nm to about 740 nm. White light is formed of a broad spectrum of different wavelengths of light, each wavelength corresponding to a different colour.

As used herein, the term "nano-structures" refers to structural entities whose major dimension is sized less than 999 nm. The terms "nano-cavities" and "nano-particles" as recited below are to be interpreted accordingly.

As used herein, the term "quantum dot" refers to a semiconductor nano-particle that confines charge carriers in three dimensions.

According to a first aspect of the present invention, there is provided a display for an aerosol-generating device, the display comprising:

a notification window;

a nano-photonic material extending over a front surface of the window;

the nano-photonic material configured to generate and radiate therefrom light comprising at least one predetermined wavelength in response to a light wave backlighting the window and being incident on the nano-photonic material.

The nano-photonic material is responsive to the incident light wave such that the incident light wave triggers or energises the nano-photonic material to generate and radiate therefrom light comprising the desired at least one predetermined wavelength. As the predetermined wavelength will correspond to an associated colour in the visible part of the electromagnetic spectrum, the use of a nano-photonic material extending over the front surface of the window provides an enhanced ability to tune the colour of the window of the display when backlit, and to compensate for any attenuation of wavelength component(s) of the incident light wave caused by the underlying window material.

Preferably, the nano-photonic material comprises a plurality of nano-structures, the nano-structures comprising either or a combination of nano-cavities and nano-particles, the nano-structures being arranged, sized or formed so as to generate and radiate therefrom light comprising the at least one predetermined wavelength in response to a light wave backlighting the window and being incident on the nano-photonic material.

Silicon-based materials and gallium nitride (GaN) are examples of suitable materials for use in forming the nano-photonic material. For example, the nano-photonic material may comprise a substrate of a silicon-based material or gallium nitride (GaN), with nano-particles arranged within the substrate. Metal oxides and indium gallium nitride (InGaN) are examples of suitable materials for the nano-particles. However, these specific materials are given only as examples. The nano-particles may conveniently take the form of quantum dots; for example, an arrangement of quantum dots may be provided within a substrate of the nano-photonic material.

Photolithography may be used to form the nano-photonic material. By way of example, if the nano-photonic material is to include both nano-cavities and nano-particles, a substrate material containing an arrangement of nano-particles may be used as a starting material. Alternatively, no nano-particles may be present in the substrate starting material. In either case, photolithography may be used to etch a predetermined arrangement of nano-cavities into the substrate starting material.

Preferably, the nano-structures are arranged, sized or formed such that the generation and radiation therefrom of light comprising the at least one predetermined wavelength is conditional upon a parameter of the incident light wave having a given value or range of values. This conditionality assists in enhancing control of under what circumstances the display radiates certain wavelengths (and thereby colours) of light, i.e. at the least one predetermined wavelength having its corresponding colour(s). Conveniently, the parameter is selected from one or more of a wavelength, a frequency and an amplitude of the incident light wave.

Advantageously, the nano-structures may comprise nano-particles arranged, sized or formed within the nano-photonic material such that individual nano-particles or groups of the nano-particles are drivable by the incident light wave to plasmonically resonate so as to generate and radiate light comprising the at least one predetermined wavelength. In this preferred aspect, the incident light wave serves to energise the nano-photonic material to induce plasmonic resonance of the individual nano-particles or the groups of nano-particles, resulting in the nano-particles emitting light at one or more desired wavelengths, i.e. at the at least one predetermined wavelength. The wavelength of light emitted by the nano-particles or groups of nano-particles through plasmonic resonance can be determined (for example, computationally) for a given configuration of nano-photonic material.

Advantageously, the plurality of nano-structures comprise a first group of nano-structures and a second group of nano-structures; the first group configured so as to generate and radiate therefrom light having a first wavelength composition, the first wavelength composition comprising at least one first predetermined wavelength; the second group configured so as to generate and radiate therefrom light having a second wavelength composition, the second wavelength composition comprising at least one second predetermined wavelength; in which the first and second wavelength compositions differ from each other. The configuration of the nano-structures in first and second groups to provide light having different wavelength compositions provides improved control of the wavelength and colour of light generated and radiated by different parts of the nano-photonic material. The first wavelength composition may consist of a single wavelength; the same may apply to the second wavelength composition. Alternatively, the first wavelength composition may consist of two or more wavelengths; again, the same may apply to the second wavelength composition.

Preferably, the first group of nano-structures comprises a first plurality of nano-particles sized and arranged within the nano-photonic material to plasmonically resonate in response to an incident light wave so as to generate and radiate light therefrom having the first wavelength composition. Similarly, the second group of nano-structures may preferably comprise a second plurality of nano-particles sized and arranged within the nano-photonic material to plasmonically resonate in response to an incident light wave so as to generate and radiate light therefrom having the second wavelength composition.

Conveniently, the first and second groups of nano-structures are arranged, sized or formed such that: the generation and radiation of light having the first wavelength composition by the first group is conditional upon a parameter of the incident light wave having a first given value or range of values; and the generation and radiation of light having the second wavelength composition by the second group is conditional upon the parameter of the incident light wave having a second given value or range of values; in which the first and second given values and range of values differ from each other. This feature provides improved control over the wavelength and colour of light radiated by different parts of the nano-photonic material. The display may further comprise a light source in optical communication with the window for backlighting the window with a light wave to fall incident on the nano-photonic material, the light source operable to switch between: the parameter of the incident light wave having the first given value or range of values; and the parameter of the incident light wave having the second given value or range of values. The parameter is conveniently selected from one or more of a wavelength, a frequency and an amplitude of the incident light wave. It can therefore be seen that changes in the incident light wave generated by the light source can be used to control the wavelength and corresponding colour of the light which is generated and radiated by the nano-photonic material.

For the various forms of nano-photonic material described above, the nano-photonic material may comprise a crystalline lattice defining a network of nano-cavities, in which individual nano-particles or groups of nano-particles are contained within one or more regions defined within the crystalline lattice between the nano-cavities. Such an arrangement of individual nano-particles or groups of nano-particles within a crystalline lattice is particularly suitable for being driven by an incident light wave to plasmonically resonate so as to generate and radiate light at desired wavelengths, i.e. at the at least one predetermined wavelength. Individual nano-cavities of the lattice may be spaced apart from each other in a predetermined pattern or repeating arrangement. However, in one or more regions within the crystalline lattice between adjacent nano-cavities, there may be a discontinuity in the predetermined pattern or repeating arrangement. The locating of individual nano-particles or groups of nano-particles in such discontinuity regions has been found particularly suitable for the generating and radiating of light by plasmonic resonance, with individual nano-particles or groups of nano-particles located in such regions being sensitive to being driven by an incident light wave to plasmonically resonate as outlined above. The wavelength emitted by individual nano-particles or groups of nano-particles located in such regions may be determined computationally based on the size and location of the regions, the size and location of the nano-cavities, the material from which the lattice and the nano-particles are made, and the size and location of the nano-particles. Different groups of nano-particles within the crystalline lattice may, in response to an incident light wave, generate and radiate therefrom light having different respective wavelength compositions. This difference in wavelength composition may be influenced by any one or more of i) the specific region in which the different groups of nano-particles are located, ii) the size and number of nano-particles in the different groups, and iii) the use of nano-particles formed of different materials in the different groups.

Advantageously, the nano-particles have a diameter in a range of between 9 nm to 120 nm. The nano-cavities may have a diameter in a range of between 100 nm to 500 nm.

Preferably, the display further comprises a light source in optical communication with the window for backlighting the window with a light wave to fall incident on the nano-photonic material. Light emitting diodes (LEDs) have been found particularly suitable as light sources, having good energy efficiency. However, other light sources capable of backlighting the window may be similarly suitable. The light source is conveniently adapted to backlight the window with a light wave comprising a spectrum of different wavelengths of light. Advantageously, the light source is adapted to switch between emitting light waves having different compositions of wavelengths. By way of example, in a first mode of operation the light source may be configured to emit a light wave comprised of one or more wavelengths which provide a red colour to the light (i.e. with wavelengths generally in the range of 625 to 740 nm); in a second mode of operation the light source may be configured to emit a light wave comprised of one or more wavelengths which provide a green colour to the light (i.e. with wavelengths generally in the range of 500 to 565 nm), and in a third mode of operation the light source may be configured to emit a light wave comprised of one or more wavelengths which provide a blue colour to the light (i.e. with wavelengths generally in the range of 450-485 nm).

The nano-photonic material is conveniently provided as a layer of nano-photonic material extending over the front surface of the window. Preferably, the layer of nano-photonic material is provided as a layer of a polymer-based film.

The display may be a dead-front display in which the window comprises material configured to attenuate light at one or more predetermined attenuation wavelengths. Preferably, the at least one predetermined wavelength is within 35080 nm of at least one of the one or more predetermined attenuation wavelengths. Accordingly, the light generated and radiated by the nano-photonic material may be of a wavelength and colour composition very similar to those wavelengths and colours of light which would be attenuated by the material of the window of the dead-front display.

In a second aspect of the invention, there is provided a display for an aerosol-generating device, the display comprising:

- a notification window;
- a nano-photonic material extending over a front surface of the window;
- the nano-photonic material configured to, in response to a light wave comprising at least one predetermined wavelength backlighting the window and being incident on the nano-photonic material, increase the amplitude of the at least one predetermined wavelength and emit therefrom a light wave comprising the at least one predetermined wavelength with the increased amplitude.

As described above, the nano-photonic material preferably comprises a plurality of nano-structures, the nano-structures comprising either or a combination of nano-cavities and nano-particles. The presence of such nano-cavities or nano-particles can be said to have an effect of enhancing the intensity of the colour associated with the at least one predetermined wavelength of light. The nano-structures may be arranged, sized or formed to, in response to a light wave comprising the at least one predetermined wavelength backlighting the window and being incident on the nano-photonic material, increase the amplitude of the at least one predetermined wavelength and emit therefrom a light wave comprising the at least one predetermined wavelength with the increased amplitude.

Advantageously, the plurality of nano-structures are arranged and sized to, in response to a light wave comprising the at least one predetermined wavelength backlighting the window and being incident on the nano-photonic material, diffract the incident light wave. Preferably, the plurality of nano-structures comprise at least a first diffraction site and a second diffraction site, the first and second diffraction sites arranged and sized to each diffract the at least one predetermined wavelength of the incident light wave by a predetermined amount, such that the diffracted predetermined wavelength of light from the first diffraction site and the diffracted predetermined wavelength of light from the second diffraction site intersect with and reinforce each other. So, the first and second diffraction sites can be thought of as functioning like the slits of a diffraction grating. Where the nano-structures comprise either or a combination of nano-cavities and nano-particles, individual ones of the nano-cavities and/or nano-particles may each individually serve as separate diffraction sites.

Preferably, the nano-photonic material is comprised of a crystalline lattice defining a network of nano-cavities. In such a crystalline lattice of nano-cavities, the nano-cavities may be arranged and sized so as to behave like the slits of a diffraction grating in response to an incident light wave, with the incident light wave passing through and being diffracted by individual ones of the nano-cavities. In a further preferred embodiment, individual nano-particles or clusters of nano-particles may be provided in the crystalline lattice between the nano-cavities. Similarly, in such a crystalline lattice containing both nano-particles and nano-cavities, the nano-particles and the nano-cavities may be arranged and sized to each individually behave like the slits of a diffraction grating in response to an incident light wave, so as to diffract the incident light wave.

As described above for the first aspect, silicon-based materials and gallium nitride (GaN) are examples of suitable materials for use in forming the nano-photonic material. For example, the nano-photonic material may comprise a substrate of a silicon-based material or gallium nitride (GaN), with nano-particles arranged within the substrate. Metal-oxides and indium gallium nitride (InGaN) are examples of suitable materials for the nano-particles. However, these specific materials are given only as examples. The nano-particles may conveniently take the form of quantum dots; for example, an arrangement of quantum dots may be provided within a substrate of the nano-photonic material.

As described above for the first aspect, photolithography may be used to form the nano-photonic material. By way of example, if the nano-photonic material is to include both nano-cavities and nano-particles, a substrate material containing an arrangement of nano-particles may be used as a starting material. Alternatively, no nano-particles may be present in the substrate starting material. In either case, photolithography may be used to etch a predetermined arrangement of nano-cavities into the substrate starting material.

As described above for the first aspect, the nano-particles preferably have a diameter in a range of between 9 nm to 120 nm. The nano-cavities preferably have a diameter in a range of between 100 nm to 500 nm.

The display may further comprise a light source in optical communication with the window for generating a light wave to backlight the window, the light wave comprising the at least one predetermined wavelength. As described above for the first aspect, light emitting diodes (LEDs) have been found particularly suitable as light sources, having good energy efficiency. However, other light sources capable of backlighting the window may be similarly suitable.

Preferably, the display is a dead-front display in which the window comprises a material configured to attenuate light at one or more predetermined attenuation wavelengths, in which the at least one predetermined wavelength is within 50 nm of the one or more predetermined attenuation wavelengths. So, the nano-photonic material is able to compensate for attenuation in amplitude of the predetermined wavelength by the window material, by acting to boost the intensity of the predetermined wavelength of light. This behaviour may be beneficial in compensating or offsetting, at least in part, the attenuating effect of a dead-front display for certain wavelengths of light during operation of the display.

As described above for the first aspect, the nano-photonic material is conveniently provided as a layer of nano-photonic material extending over the front surface of the window. Preferably, the layer of nano-photonic material is provided as a layer of a polymer-based film.

In a third aspect, there may be provided a display for an aerosol-generating device, the display comprising a notification window; a nano-photonic material extending over a front surface of the window; in which the nano-photonic material is configured in accordance with both of the first and second aspects outlined above.

Advantageously, there is provided an aerosol-generating device comprising the display as outlined in any of the preceding paragraphs in relation to the first three aspects, in which the aerosol-generating device further comprises: a housing, wherein the display is integrated into the housing; and a light source enclosed within the housing and in optical communication with the window for backlighting the window with a light wave to fall incident on the nano-photonic material. Preferably, the window is a notification window in which a colour of the window (as visible to a user of the aerosol-generating device), in response to the light source backlighting the window provides the user with a notification of the status of the device. The colour of the notification window may provide an indication as to whether the aerosol-generating device (or a component part thereof) has reached or exceeded a design operating temperature. For example, a blue colour for the backlit window may be indicative of a heating element of the aerosol-generating device not yet having reached a design operating temperature, whereas a green colour for the backlit window may be indicative of the heating element having attained the design operating temperature, whereas a red colour may be indicative of the heating element having exceeded the design operating temperature. Of course, it is understood that in other embodiments, there may be a different association between a given colour of the backlit notification window and a given status of the aerosol-generating device.

Conveniently, the aerosol-generating device is a smoking article for generating aerosol for inhalation by a user. Alternatively, the aerosol-generating device is configured to cooperate with a smoking article so as to induce the smoking article to generate aerosol for inhalation by a user. The aerosol-generating device is preferably elongate in form and sized so as to be suitable for being held between the thumb and fingers of a user. The aerosol-generating device is preferably cylindrical in cross-section. Conveniently, the housing of the device is adapted to contain an aerosol-forming substrate. A power source and a heating element are also preferably contained within the housing of the device, the power source configured to provide electrical power to the heating element such that the heating element is able to apply heat to the aerosol-forming substrate so as to generate a vapour from the substrate. It is preferred that this same power source also provides electrical power to any light source provided in the device used to backlight the window of the display. The aerosol-forming substrate may conveniently be provided as part of a replaceable cartridge. Preferably, the aerosol-forming substrate is provided in a solid form, although the aerosol-forming substrate may alternatively be provided in liquid form. The aerosol-forming substrate may comprise nicotine. The aerosol-forming substrate may comprise plant-based material. The aerosol-forming substrate may comprise tobacco. The aerosol-forming substrate may comprise homogenised tobacco material. The aerosol-forming substrate may comprise a non-tobacco-containing material. The aerosol-forming substrate may comprise homogenised plant-based material.

The invention is defined in the claims. However, below there is provided a non-exhaustive list of non-limiting examples. Any one or more of the features of these examples may be combined with any one or more features of another example, embodiment, or aspect described herein.

Example Ex1: A display for an aerosol-generating device, the display comprising: a notification window; a nano-photonic material extending over a front surface of the window; the nano-photonic material configured to generate and radiate therefrom light comprising at least one predetermined wavelength in response to a light wave backlighting the window and being incident on the nano-photonic material.

Example Ex2: The display according to example Ex1, in which the nano-photonic material comprises a plurality of nano-structures, the nano-structures comprising either or a combination of nano-cavities and nano-particles, the nano-structures being arranged, sized or formed so as to generate and radiate therefrom light comprising the at least one predetermined wavelength in response to a light wave backlighting the window and being incident on the nano-photonic material.

Example Ex3: The display according to example Ex2, in which the nano-structures are arranged, sized or formed such that the generation and radiation therefrom of light comprising the at least one predetermined wavelength is conditional upon a parameter of the incident light wave having a given value or range of values.

Example Ex4: The display according to example Ex3, in which the parameter is selected from one or more of a wavelength, a frequency and an amplitude of the incident light wave.

Example Ex5: The display according to any one of examples Ex2 to Ex4, in which the nano-structures comprise nano-particles arranged, sized or formed within the nano-photonic material such that individual nano-particles or groups of the nano-particles are drivable by the incident light wave to plasmonically resonate so as to generate and radiate light comprising the at least one predetermined wavelength.

Example Ex6: The display according to any one of examples Ex2 to Ex5, in which the plurality of nano-structures comprise at least a first group of nano-structures and a second group of nano-structures; the first group configured so as to generate and radiate therefrom light having a first wavelength composition, the first wavelength composition comprising at least one first predetermined wavelength; the second group configured so as to generate and radiate therefrom light having a second wavelength composition, the second wavelength composition comprising at least one second predetermined wavelength; in which the first and second wavelength compositions differ from each other.

Example Ex7: The display according to example Ex6, in which the first and second groups of nano-structures are arranged, sized or formed such that: the generation and radiation of light having the first wavelength composition by the first group is conditional upon a parameter of the incident light wave having a first given value or range of values; and the generation and radiation of light having the second wavelength composition by the second group is conditional upon the parameter of the incident light wave having a second given value or range of values; in which the first and second given values and range of values differ from each other.

Example Ex8: The display according to example Ex7, further comprising a light source in optical communication with the window for backlighting the window with a light wave to fall incident on the nano-photonic material, the light source operable to switch between: the parameter of the incident light wave having the first given value or range of values; and the parameter of the incident light wave having the second given value or range of values.

Example Ex9: The display according to either of examples Ex7 or Ex8, in which the parameter is selected from one or more of a wavelength, a frequency and an amplitude of the incident light wave.

Example Ex10: The display according to any one of examples Ex2 to Ex9, in which the nano-photonic material is comprised of a crystalline lattice defining a network of nano-cavities, in which individual nano-particles or groups of nano-particles are contained within one or more regions defined within the crystalline lattice between the nano-cavities.

Example Ex11: The display according to any one of examples Ex2 to Ex10, in which the nano-particles have a diameter in a range of between 9 nm to 120 nm.

Example Ex12: The display according to any one of examples Ex2 to Ex11, in which the nano-cavities have a diameter in a range of between 100 nm to 500 nm.

Example Ex13: The display according to any one of examples Ex1 to Ex12, the display further comprising a light source in optical communication with the window for backlighting the window with a light wave to fall incident on the nano-photonic material.

Example Ex14: The display according to any one of examples Ex1 to Ex13, in which the display is a dead-front display in which the window comprises material configured to attenuate light at one or more predetermined attenuation wavelengths.

Example Ex15: The display according to example Ex14, in which the at least one predetermined wavelength is within 50 nm of at least one of the one or more predetermined attenuation wavelengths.

Example Ex16: A display for an aerosol-generating device, the display comprising: a notification window; a nano-photonic material extending over a front surface of the window; the nano-photonic material configured to, in response to a light wave comprising at least one predetermined wavelength backlighting the window and being incident on the nano-photonic material, increase the amplitude of the at least one predetermined wavelength and emit therefrom a light wave comprising the at least one predetermined wavelength with the increased amplitude.

Example Ex17: The display according to example Ex16, in which the nano-photonic material comprises a plurality of nano-structures, the nano-structures comprising either or a combination of nano-cavities and nano-particles, the nano-structures being arranged, sized or formed to, in response to a light wave comprising the at least one predetermined wavelength backlighting the window and being incident on the nano-photonic material, increase the amplitude of the at least one predetermined wavelength and emit therefrom a light wave comprising the at least one predetermined wavelength with the increased amplitude.

Example Ex18: The display according to example Ex17, in which the plurality of nano-structures are arranged and sized to, in response to a light wave comprising the at least one predetermined wavelength backlighting the window and being incident on the nano-photonic material, diffract the incident light wave.

Example Ex19: The display according to example Ex18, in which the plurality of nano-structures comprise at least a first diffraction site and a second diffraction site, the first and second diffraction sites arranged and sized to each diffract the at least one predetermined wavelength of the incident light wave by a predetermined amount, such that the diffracted predetermined wavelength of light from the first diffraction site and the diffracted predetermined wavelength of light from the second diffraction site intersect with and reinforce each other.

Example Ex20: The display according to any one of examples Ex17 to Ex19, in which the nano-photonic material is comprised of a crystalline lattice defining a network of nano-cavities.

Example Ex21: The display according to example Ex20, in which individual nano-particles or clusters of nano-particles are provided in the crystalline lattice between the nano-cavities.

Example Ex22: The display according to any one of examples Ex17 to Ex21, in which the nano-particles have a diameter in a range of between 9 nm to 120 nm.

Example Ex23: The display according to any one of examples Ex17 to Ex22, in which the nano-cavities have a diameter in a range of between 100 nm to 500 nm.

Example Ex24: The display according to any one of examples Ex16 to Ex23, the display further comprising a light source in optical communication with the window for generating a light wave to backlight the window, the light wave comprising the at least one predetermined wavelength.

Example Ex25: The display according to any one of examples Ex16 to Ex24, in which the display is a dead-front display in which the window comprises a material configured to attenuate light at one or more predetermined attenuation wavelengths, in which the at least one predetermined wavelength within 50 nm of the one or more predetermined attenuation wavelengths.

Example Ex26: The display according to any one of examples Ex1 to Ex25, in which the nano-photonic material is provided as a layer of nano-photonic material extending over the front surface of the window.

Example Ex27: An aerosol-generating device comprising the display according to any one of examples Ex1 to Ex26, in which the aerosol-generating device further comprises: a housing, wherein the display is integrated into the housing; a light source enclosed within the housing and in optical communication with the window for backlighting the window with a light wave to fall incident on the nano-photonic material.

Example Ex28: The aerosol-generating device according to example Ex27, in which the aerosol-generating device further comprises a heating element configured to apply heat to an aerosol-forming substrate located within the aerosol-generating device.

Example Ex29: The aerosol-generating device according to either of example Ex27 or example Ex28, in which the window is a notification window, in which a colour of the window in response to the light source backlighting the window with a light wave provides a notification of the status of the device.

Example Ex30: The aerosol-generating device according to any one of examples Ex27 to Ex29, in which the aerosol-generating device is a smoking article for generating aerosol for inhalation by a user.

Example Ex31: The aerosol-generating device according to any one of examples Ex27 to Ex29, in which the aerosol-generating device is configured to cooperate with a smoking article so as to induce the smoking article to generate aerosol for inhalation by a user.

Examples will now be further described with reference to the figures, in which.

Figure 1:
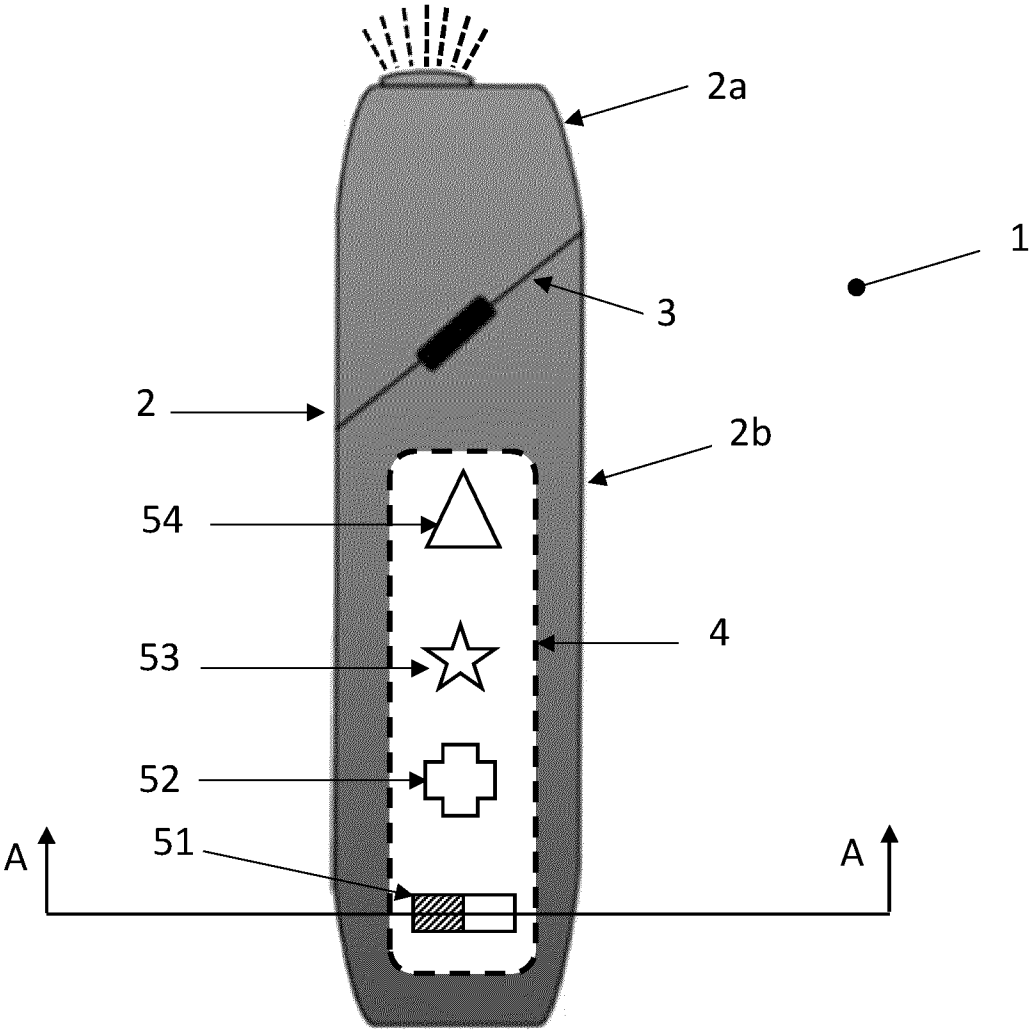
FIG. 1 shows a schematic view of an aerosol-generating device provided with a display.

FIG. 1 shows an aerosol-generating device 1. The aerosol-generating device 1 is elongate and generally cylindrical in cross-section, with a housing 2 having an upper part 2*a* and a lower part 2*b*. The parts 2*a*, 2*b* of the housing mate with each other at a diagonal interface 3. A display 4 is integrated into the housing 2. The display includes four notification windows 51, 52, 53, 54. The notification windows 51, 52, 53, 54 define icons of different shapes. The aerosol-generating device 1 is sized in length and diameter so as to be suitable for being held between the thumb and fingers of a user. The aerosol-generating device 1 shown in FIG. 1 is a smoking article for generating smoke for inhalation by a user. Although not shown in the figures, a replaceable cartridge containing aerosol-forming substrate and an electrically-powered heating element are enclosed within the housing 2 of the device 1, with the heating element operable to apply heat to the aerosol-forming substrate to generate an inhalable aerosol therefrom, for inhaling from an opening in the upper part 2*a* of the housing 2 of the device 1. This inhalable aerosol is represented by the array of dashed lines in FIG. 1 emanating from the upper part 2*a* of the housing 2.

Figure 2:
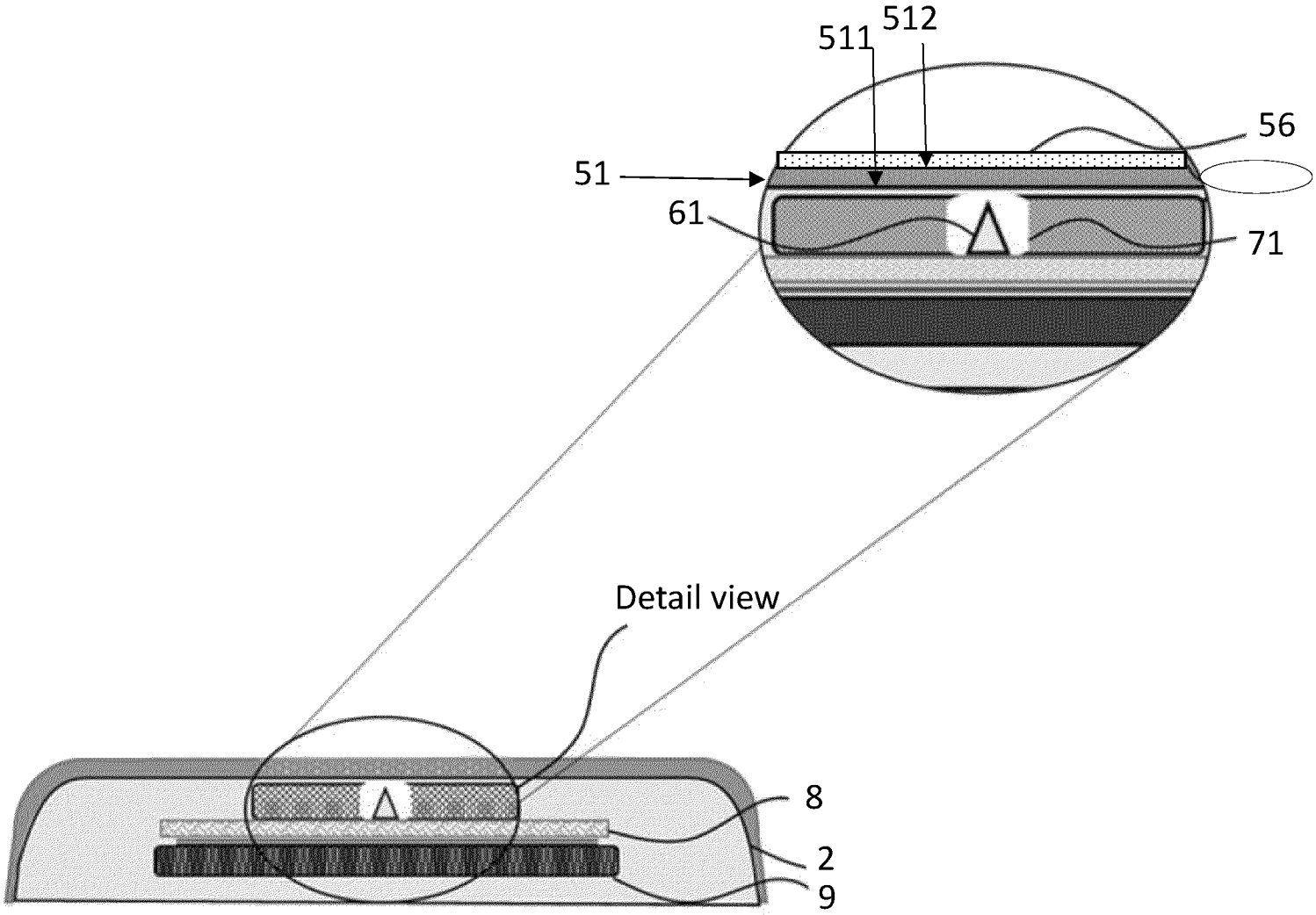
FIG. 2 shows a cross-sectional view of the aerosol-generating device of FIG. 1 along line A-A of FIG. 1 (including a detail view of the display).

FIG. 2 shows a cross-sectional view of the aerosol-generating device 1 along line A-A of FIG. 1, corresponding to the location of the lowermost notification window 51 of the display 4. An accompanying detail view localised on the notification window 51 is also provided in FIG. 2. A light source 61 is located within a cavity 71 provided inside the housing 2. For the embodiment shown, the light source 61 is a light-emitting diode (LED). The light source 61 is mounted on a printed circuit board 8 which contains wiring and control circuitry (not shown) for controlling the operation of the light source. The printed circuit board 8 is electrically coupled to a power source 9 for providing power to the light source 61. The power source 9 not only provides power to the printed circuit board 8, the light source 61 and other components mounted on the printed circuit board, but also provides power to the heating element (not shown) used to apply heat to the aerosol-forming substrate (also not shown). For the embodiment shown in FIG. 2, the power source 9 is a rechargeable battery. The cavity 71 is arranged such that the light source 61 is in optical communication with a back-facing surface 511 of the notification window 51. In use, the light source 61 illuminates the back-facing surface 511 of the notification window 51 with a light wave to thereby backlight the window for viewing by a user of the device 1. The cavity 71 is arranged such that a light wave from the light source 61 backlights the window 51 without illuminating any of the other three notification windows 52, 53, 54 of the display 4. The printed circuit board 8 extends for the length of the display 4. Three additional light sources (not shown) are mounted on the printed circuit board 8 and are located within respective cavities (also not shown) for backlighting each of the remaining three notification windows 52, 53, 54. The configuration of the light source 61 and the notification window 51 is indicative of the configuration of the notification windows 52, 53, 54 and their own respective light sources.

For the aerosol-generating device 1, the display 4 is a dead-front display, in which each of the windows 51, 52, 53, 54 appear tinted when viewed from outside of the device, so as to correspond in colour to the housing 2 when their respective light sources (for example, light source 61 for window 51) are inactive. The window 51 is made of a polymer configured to attenuate light at one or more predetermined attenuation wavelengths, thereby imparting a tint to the window 51. A layer of nano-photonic material 56 overlies a front-facing surface 512 of the window 51 (see FIG. 2).

Figure 3:
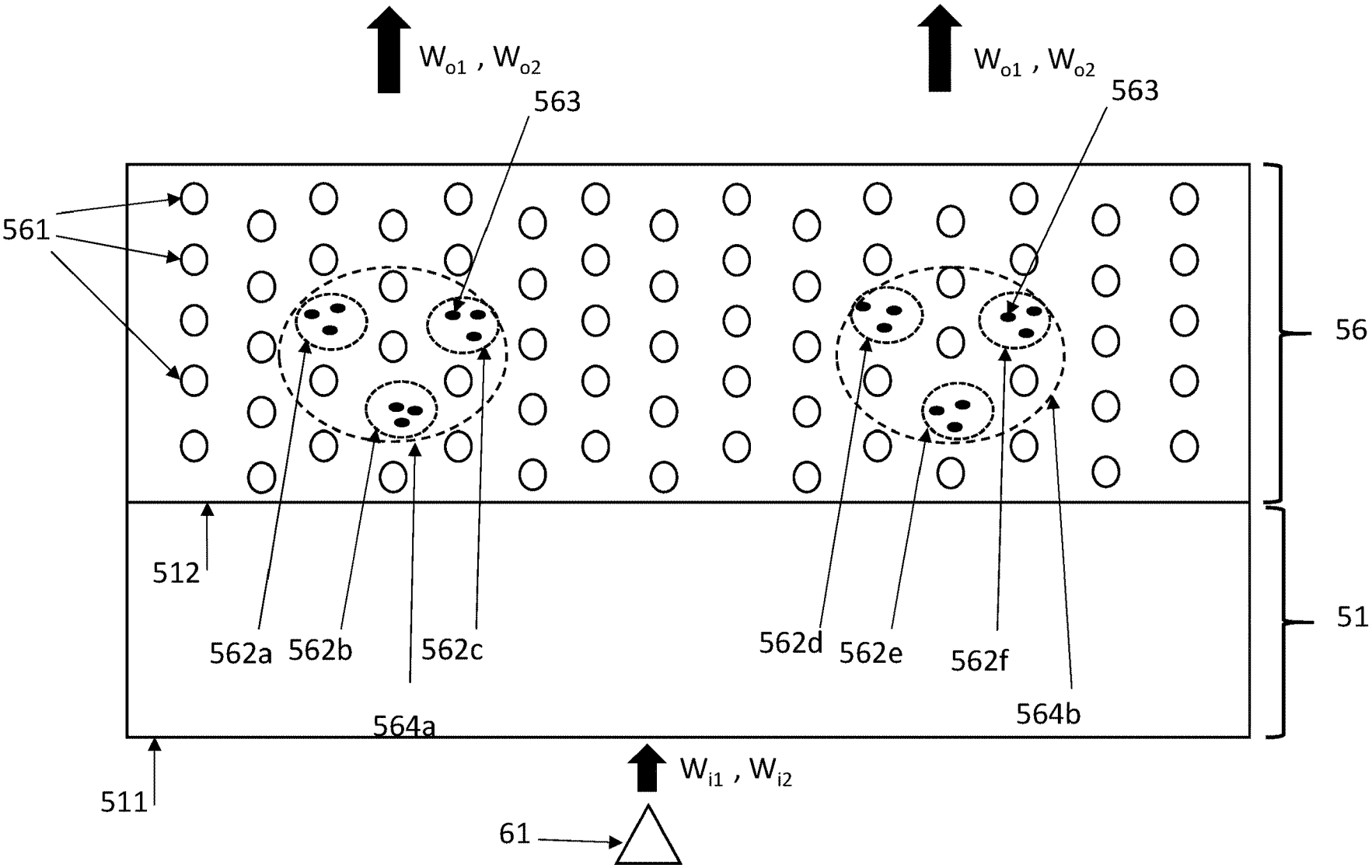
FIG. 3 shows a cross-sectional schematic view of a first embodiment of a display for use with the aerosol-generating device of FIG. 1.

FIG. 3 shows a schematic representation of a first embodiment of the layer of nano-photonic material 56 overlying the front-facing surface 512 of the window 51. The layer of nano-photonic material 56 is provided as a layer of a polymer-based film. The layer of nano-photonic material 56 is formed of a crystalline lattice of gallium nitride (GaN) defining a network of nano-cavities 561. The nano-cavities 561 are spaced apart from each other in a predetermined pattern or repeating arrangement. However, the lattice is fabricated so as to define discontinuities in the predetermined pattern or arrangement of nano-cavities 561. These discontinuities are located in regions 562*a* to 562*f* of the crystalline lattice. The discontinuities in regions 562*a* to 562*c* define a triangular pattern, as do the discontinuities in regions 562*d* to 562*f*. For the embodiment shown in FIG. 3, each discontinuity region 562*a* to 562*f* contains a group of nano-particles 563 in the form of quantum dots formed of indium gallium nitride (InGaN). As can be seen from FIG. 3, the nano-photonic material 56 has been fabricated to provide clusters 564*a*, 564*b* of the groups of nano-particles 563. For the embodiment shown in FIG. 3, each cluster 564*a*, 564*b* consists of three groups of nano-particles 563 arranged in a triangular configuration. The six groups of nano-particles 563 (three per cluster 564*a*, 564*b*) are located in the six discontinuity regions 562*a* to 562*f* of the crystalline lattice. The nano-cavities 561 are each sized to have a diameter in a range of between 100 nm to 500 nm. The nano-particles 563 are sized to have diameters in a range of between 9 nm to 120 nm.

The behaviour of the nano-photonic material 56 overlying the front-facing surface 512 of the notification window 51 for the embodiment of FIG. 3 is discussed in response to the window being backlit by a light wave generated by light source 61. The light source 61 is configured to generate first and second incident light waves $W_{i1}$ and $W_{i2}$ at different points in time, dependent on and according to instructions provided by the control circuitry provided on the printed circuit board 8. For the embodiment shown and described in FIG. 3, the first and second incident light waves $W_{i1}$ and $W_{i2}$ have distinct wavelength compositions. For the illustrated embodiment, the first incident light wave $W_{i1}$ is composed of "m" constituent wavelengths to provide a wavelength composition of $\lambda_{i1.1}, \lambda_{i1.2} \ldots \lambda_{i1.m}$; and the second incident light wave $W_{i2}$ is composed of "n" constituent wavelengths to provide a wavelength composition of $\lambda_{i2.1}, \lambda_{i2.2} \ldots \lambda_{i2.n}$. The wavelength composition of the first incident light wave $W_{i1}$ is different to that the second incident light wave $W_{i2}$. In an alternative embodiment, the first and second incident light waves $W_{i1}$ and $W_{i2}$ may each instead consist of a single wavelength, with the wavelength of the first incident light wave $W_{i1}$ being different to that of the second incident light wave $W_{i2}$.

When the light source generates first incident light wave $W_{i1}$, the light wave $W_{i1}$ first passes through the window 51 to fall incident on the layer of nano-photonic material 56. On entering the nano-photonic material 56, the light wave $W_{i1}$ has the effect of driving or energising the clusters 564*a*, 564*b* of the groups of nano-particles 563 to plasmonically resonate. For the example of FIG. 3, the wavelength composition $\lambda_{i1.1}, \lambda_{i1.2} \ldots \lambda_{i1.m}$ of the light wave $W_{i1}$ generated by light source 61 is selected to not include any of one or more predetermined attenuation wavelengths of the window material 51. This helps to ensure that the light wave $W_{i1}$, when falling incident upon the layer of nano-photonic material 56, after having passed between the back-facing and front-facing surfaces 511, 512 of the window 51, retains sufficient amplitude and energy to drive each of the clusters 564*a*, 564*a* of the groups of nano-particles 563 to plasmonically resonate. For the example shown in FIG. 3, the arrangement and size of the clusters 564*a*, 564*b* and their respective nano-particles 563 is such that each cluster 564*a*, 564*b* generates and radiates an output light wave $W_{o1}$, having an output wavelength $\lambda_{o1}$ corresponding to a desired or predetermined colour of light. Accordingly, to a person viewing the window 51 of the display 4 when backlit by the light source 61, the window appears to be illuminated with a colour corresponding to the output wavelength $\lambda_{o1}$.

When the light source 61 is switched, by virtue of instructions provided by the control circuitry of the printed circuit board 8, to generate the second light wave $W_{i2}$ having the second wavelength composition $\lambda_{i2.1}, \lambda_{i2.2} \ldots \lambda_{i2.n}$, the light wave $W_{i2}$ passes through the window 51 to fall incident upon the layer of nano-photonic material 56. As for light wave $W_{i1}$, light wave $W_{i2}$ also has the effect of driving or energising the clusters 564*a*, 564*b* of the groups of nano-particles 563 to plasmonically resonate. Again, the wavelength composition $\lambda_{i2.1}, \lambda_{i2.2} \ldots \lambda_{i2.n}$ of the light wave $W_{i2}$ generated by the light source 61 is selected to not include any of one or more predetermined attenuation wavelengths of the window material 51, so as to ensure that the light wave $W_{i2}$ retains sufficient amplitude and energy to drive the clusters 564*a*, 564*b* to plasmonically resonate. The arrangement, size and material of the clusters 564*a*, 564*b* of nano-particles 563 is such that each cluster 564*a*, 564*b* generates and radiates an output light wave $W_{o2}$ having an output wavelength $\lambda_{o2}$ corresponding to a desired or predetermined colour of light. The output wavelength $\lambda_{o2}$ of output light wave $W_{o2}$ is different to the output wavelength $\lambda_{o1}$ of output light wave $W_{o1}$. So, the light waves $W_{i1}$, $W_{i2}$ with their different wavelength compositions ($\lambda_{i1.1}$, $\lambda_{i1.2} \ldots \lambda_{i1.m}$), ($\lambda_{i2.1}, \lambda_{i2.2} \ldots \lambda_{i2.n}$) drive the clusters 564*a*, 564*a* to each generate and radiate different output light waves $W_{o1}$, $W_{o2}$ consisting of different respective output wavelengths $\lambda_{o1}$, $\lambda_{o2}$. The different output wavelengths $\lambda_{o1}$, $\lambda_{o2}$ correspond to different colours of light. So, a person viewing the window 51 of the display 4 when backlit with light wave $W_{i1}$ having wavelength composition $\lambda_{i1.1}$, $\lambda_{i1.2} \ldots \lambda_{i1.m}$ will see the window appear illuminated with a different colour compared to when the window 51 is backlit with light wave $W_{i2}$ having wavelength composition $\lambda_{i2.1}, \lambda_{i2.2} \ldots \lambda_{i2.n}$. The different colours can be indicative of the status of the aerosol-generating device at a given time. For example, an output wavelength $\lambda_{o1}$ of about 470 nm (corresponding generally to a blue colour of light) may be indicative of the heating element of the aerosol-generating device 1 not yet having reached its design operating temperature, whereas an output wavelength of $\lambda_{o2}$ of about 530 nm (corresponding generally to a green colour of light) may be indicative of the heating element having attained its design operating temperature. Of course in other embodiments, the clusters 564*a*, 564*b* of nano-particles 563 may be arranged, sized or formed of a material such that they generate and radiate light at an output wavelength corresponding to different colours.

Figure 4:
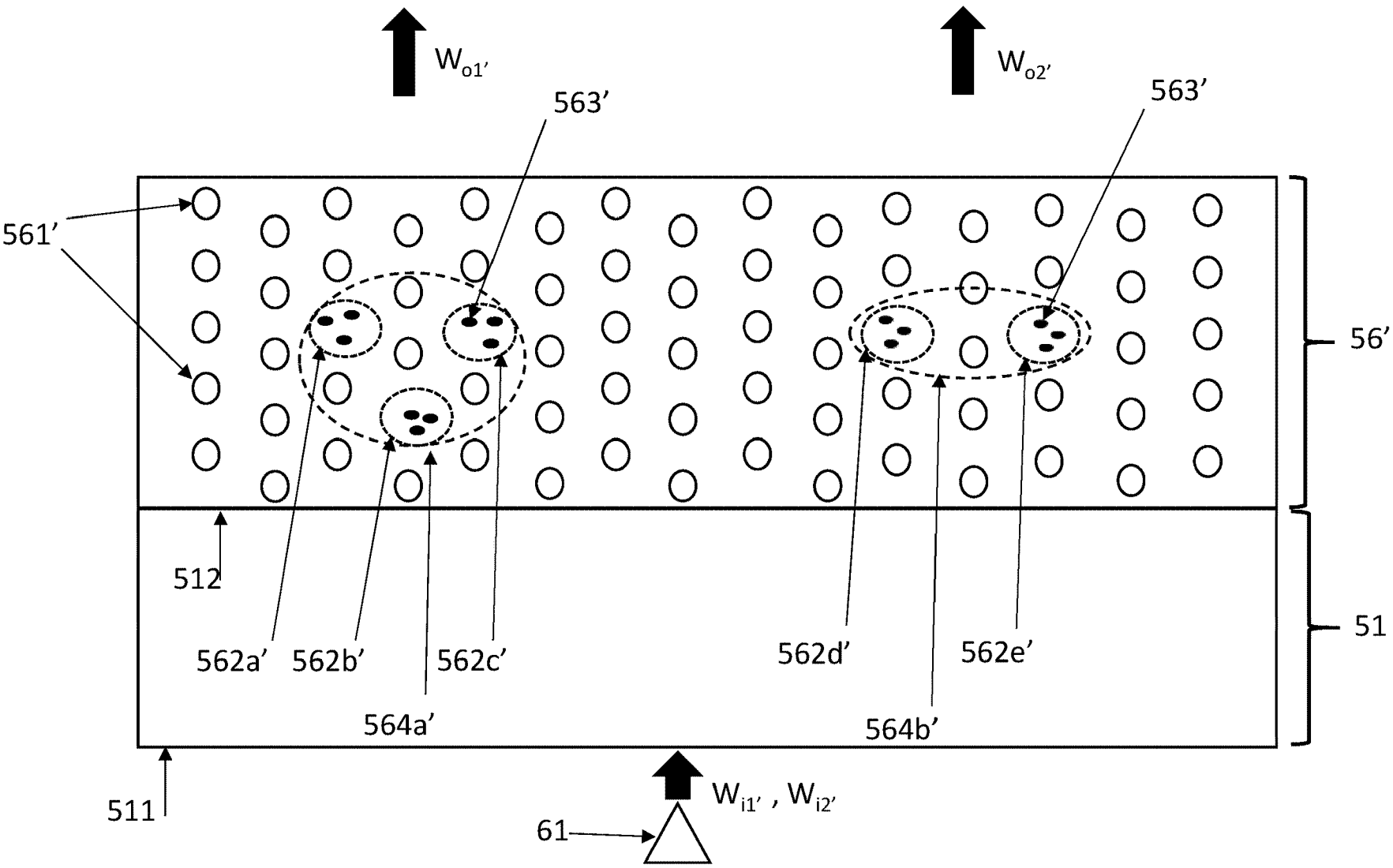
FIG. 4 shows a cross-sectional view schematic of a second embodiment of a display for use with the aerosol-generating device of FIG. 1.

FIG. 4 shows a schematic representation of a second embodiment of the layer of nano-photonic material 56' overlying the front-facing surface 512 of the window 51. The layer of nano-photonic material 56' is formed of a crystalline lattice defining a network of nano-cavities 561'. The nano-cavities 561' are spaced apart from each other in a predetermined pattern or repeating arrangement. In common with the embodiment of FIG. 3, the lattice is fabricated so as to define discontinuities in the predetermined pattern or arrangement of nano-cavities 561'. These discontinuities are located in regions 562*a'* to 562*e'* of the crystalline lattice. The discontinuities in regions 562*a'* to 562*c'* define a triangular pattern, whereas the discontinuities in regions 562*d'* to 562*e'* define a linear pattern. Each discontinuity region 562*a'* to 562*e'* contains a group of nano-particles 563' in the form of quantum dots. As can be seen from FIG. 4, the nano-photonic material 56' has been fabricated to provide clusters 564*a'*, 564*b'* of the groups of nano-particles 563'. For the embodiment of FIG. 4, cluster 564*a'* consists of three groups of nano-particles 563' in a triangular arrangement and cluster 564*b'* consists of two groups of nano-particles 563' in a linear arrangement. The five groups of nano-particles 563' are located in the five discontinuity regions 562*a'* to 562*e'*. As for the embodiment of FIG. 3, the nano-cavities 561' are each sized to have a diameter in a range of between 100 nm to 500 nm, and the nano-particles 563' sized to have diameters in a range of between 9 nm to 120 nm. However, the nano-particles in cluster 564*a'* are formed of a material differing in composition from that of the nano-particles in cluster 564*b'*. As explained below, the use of different materials for the nano-particles 563' of the different clusters 564*a'*, 564*b'* results in the nano-particles 563' of the different clusters 564*a'*, 564*b'* responding differently to two different incident light waves, with the differing response being dependent on differences in one or more parameters between two such incident light waves.

The behaviour of the nano-photonic material 56' overlying the front-facing surface 512 of the notification window 51 for the embodiment of FIG. 4 is discussed in response to the window being backlit by a light wave generated by light source 61. The light source 61 is configured to generate first and second light waves $W_{i1'}$ and $W_{i2'}$ at different points in time, dependent on and according to instructions provided by the control circuitry provided on the printed circuit board 8. For the embodiment described, the incident light waves $W_{i1'}$ and $W_{i2'}$ have distinct wavelength compositions. For the illustrated embodiment, the first incident light wave $W_{i1'}$ is composed of "m" constituent wavelengths to provide a wavelength composition of $\lambda_{i1'.1}, \lambda_{i1'.2} \ldots \lambda_{i1'.m}$; and the second incident light wave $W_{i2'}$ is composed of "n" constituent wavelengths to provide a wavelength composition of $\lambda_{i2'.1}, \lambda_{i2'.2} \ldots \lambda_{i2'.n}$. The wavelength composition of the first incident light wave $W_{i1'}$ is different to that the second incident light wave $W_{i2'}$. In an alternative embodiment, the first and second incident light waves $W_{i1'}$ and $W_{i2'}$ may each instead consist of a single wavelength, with the wavelength of the first incident light wave $W_{i1'}$ being different to that of the second incident light wave $W_{i2'}$.

When the light source generates first incident light wave $W_{i1'}$, the light wave $W_{i1'}$ first passes through the window 51 to fall incident on the layer of nano-photonic material 56'. On entering the nano-photonic material 56', the light wave $W_{i1'}$ drives and energises the cluster 564*a'* of nano-particles 563 to plasmonically resonate. The arrangement, size and material of the cluster 564*a'* and its respective nano-particles 563' result in the cluster 564*a'* generating and radiating an output light wave $W_{o1'}$ having an output wavelength $\lambda_{o1'}$ corresponding to a desired or predetermined colour of light. However, the different material used for the nano-particles 563' of cluster 564*b'* is such that the nano-particles 563' of cluster 564*b'* are unresponsive to the first incident light wave $W_{i1'}$ consisting of wavelength composition $\lambda_{i1'.1}, \lambda_{i1'.2} \ldots \lambda_{i1'.m}$, resulting in no or negligible plasmonic resonance of the nano-particles 563' of cluster 564*b'*. So, to a person viewing the window 51 of the display 4 when the window is backlit by light wave $W_{i1'}$ with wavelength composition $\lambda_{i1'.1}, \lambda_{i1'.2} \ldots \lambda_{i1'.m}$, the window would appear illuminated with a colour corresponding to the output wavelength $\lambda_{o1'}$ of the light generated and radiated by cluster 564*a'* only.

When the light source 61 is switched, by virtue of instructions provided on the control circuitry of the printed circuit board 8, to generate the second incident light wave $W_{i2'}$ having second wavelength composition $\lambda_{i2'.1}, \lambda_{i2'.2} \ldots \lambda_{i2'.n}$, the light wave $W_{i2'}$ passes through the window 51 to fall incident upon the layer of nano-photonic material 56'.

On entering the nano-photonic material 56', the light wave $W_{i2'}$ drives and energises the cluster 564*b*' of nano-particles 563' to plasmonically resonate. The arrangement and size of the cluster 564*b*' and its constituent nano-particles 563' results in the cluster 564*b*' generating and radiating an output light wave $W_{o2'}$ having an output wavelength $\lambda_{o2'}$ corresponding to a desired or predetermined colour of light. However, the different material used for the nano-particles 563' of cluster 564*a*' is such that the nano-particles 563' of cluster 564*a*' are unresponsive to the second incident light wave $W_{i2'}$ consisting of wavelength composition $\lambda_{i2'.1}$, $\lambda_{i2'.2}$ . . . $\lambda_{i2'.n}$, resulting in no or negligible plasmonic resonance of the nano-particles 563' of cluster 564*a*'. So, to a person viewing the window 51 of the display 4 when the window is backlit by light wave $W_{i2'}$ with wavelength composition $\lambda_{i2'.1}$, $\lambda_{i2'.2}$ . . . $\lambda_{i2'.n}$, the window would appear illuminated with a colour corresponding to the output wavelength $\lambda_{o2'}$ of the light generated and radiated by cluster 564*b*' only.

The embodiment of FIG. 4 illustrates how the use of different materials for the nano-particles 563' of the different clusters 564*a*', 564*b*' can result in these different clusters reacting differently to incident light waves $W_{i1'}$, $W_{i2'}$ differing in one or more parameters. For the embodiment of FIG. 4, the light waves $W_{i1'}$, $W_{i2'}$ differ in their wavelength composition. However, in alternative embodiments, the nano-particles of the different clusters 564*a*', 564*b*' may instead react differently according to differences in the frequency and/or amplitude of the light waves $W_{i1'}$, $W_{i2'}$. Further, for the embodiment shown in FIG. 4, the different arrangement of the clusters 564*a*' (triangular pattern) and 564*b*' (linear pattern) also results in each cluster generating and radiating light of different wavelengths.

The output wavelength $\lambda_{o1'}$ of output light wave $W_{o1'}$ from cluster 564*a*' is different to the output wavelength $\lambda_{o2'}$ of output light wave $W_{o2'}$ from cluster 564*b*'. The different output wavelengths $\lambda_{o1'}$, $\lambda_{o2'}$ correspond to different colours of light.

Figure 5:
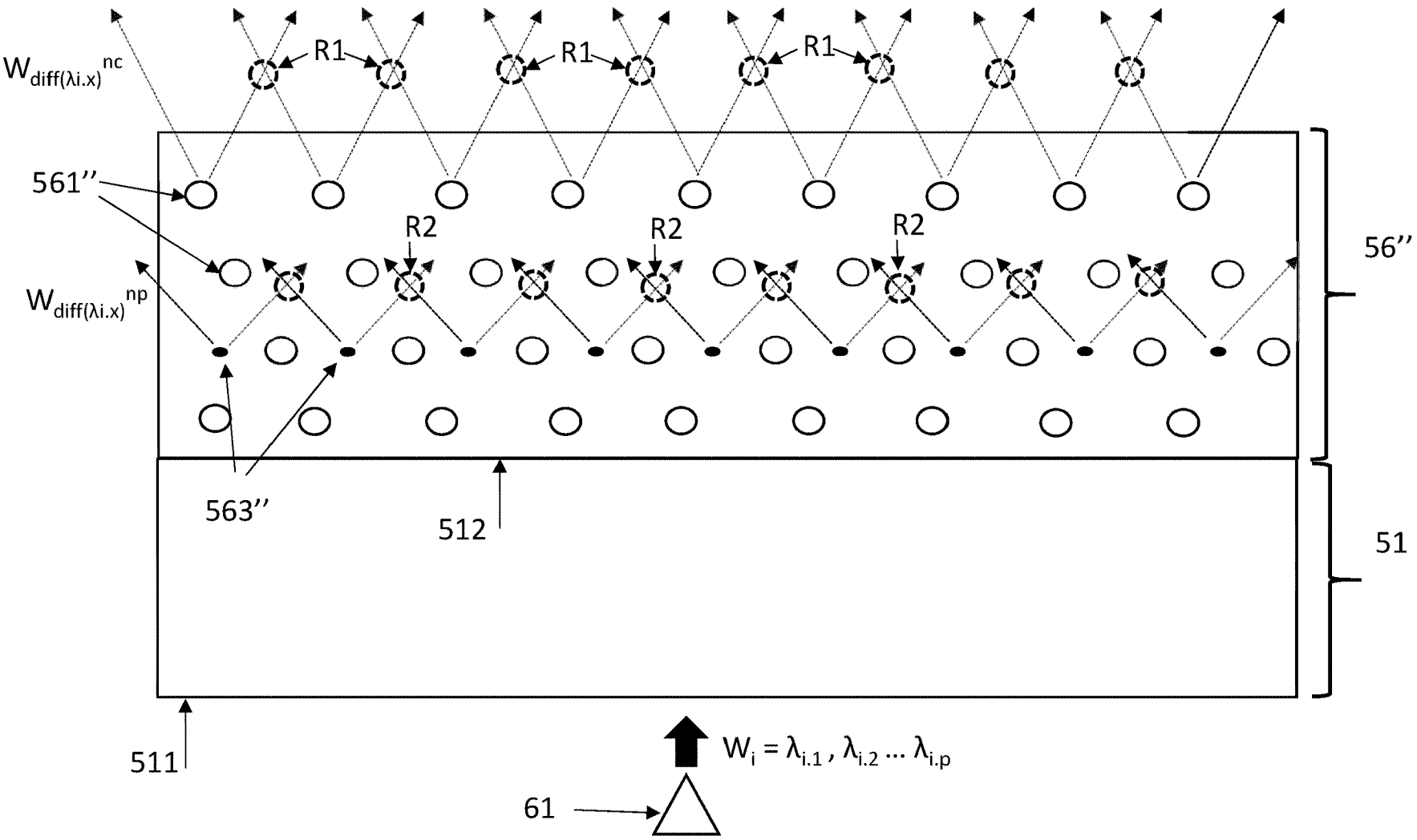
FIG. 5 shows a cross-sectional schematic view of a third embodiment of a display for use with the aerosol-generating device of FIG. 1.

FIG. 5 shows a schematic representation of a third embodiment of the layer of nano-photonic material 56" overlying the front-facing surface 512 of the window 51. The layer of nano-photonic material 56" is provided as a layer of a polymer-based film. The layer of nano-photonic material 56" is formed of a crystalline lattice of gallium nitride (GaN) defining a network of nano-cavities 561". The nano-cavities 561" are spaced apart from each other in a predetermined pattern or repeating arrangement. In contrast to the embodiments of FIGS. 3 and 4, the lattice for this third embodiment is fabricated to avoid or minimise the presence of discontinuities in the predetermined pattern or arrangement of nano-cavities 561". Nano-particles 563" are dispersed throughout the lattice in a predetermined pattern and spacing, being located between adjacent ones of the nano-cavities 561". The nano-particles 563" are in the form of quantum dots formed of indium gallium nitride (InGaN). The nano-cavities 561" are each sized to have a diameter in a range of between 100 nm to 500 nm. The nano-particles 563" are sized to have diameters in a range of between 9 nm to 120 nm.

The behaviour of the nano-photonic material 56" overlying the front-facing surface 512 of the notification window 51 for the embodiment of FIG. 5 is discussed in response to the window being backlit by a light wave generated by light source 61. The light source 61 is configured to generate incident light wave $W_i$, according to instructions provided by control circuitry provided on the printed circuit board 8. For the embodiment shown and described in FIG. 5, the incident light wave $W_i$ has a wavelength composition consisting of "p" constituent wavelengths $\lambda_{i.1}$, $\lambda_{i.2}$ . . . $\lambda_{i.p}$. In an alternative embodiment, the incident light wave $W_i$ may instead consist of a single wavelength.

When the light source 61 generates incident light wave $W_i$, the light wave first passes through the window 51 to fall incident on the layer of nano-photonic material 56". On entering the nano-photonic material 56", the individual nano-cavities 561" and nano-particles 563" function like the slits of a diffraction grating, to diffract the constituent wavelengths of the incident light wave $W_i$. The action of the individual nano-cavities 561" and nano-particles 563" in diffracting a specific predetermined wavelength $\lambda_{i.x}$ present in the incident light wave $W_i$ is discussed below with reference to FIG. 5. As the incident light wave $W_i$ passes through the nano-photonic material 56", the nano-cavities 561" and nano-particles 563" diffract or deflect the constituent wavelengths present in the incident light wave. Different constituent wavelengths present in the incident light wave $W_i$ are diffracted by different amounts. The diffraction by nano-cavities 561" and nano-particles 563" of the predetermined wavelength component $\lambda_{i.x}$ present in incident light wave $W_i$ into diffracted light waves $W_{diff(\lambda i.x)}^{nc}$ and $W_{diff(\lambda i.x)}^{np}$ respectively is shown in FIG. 5. The diffracted light waves $W_{diff(\lambda i.x)}^{nc}$ emanating from different ones of the nano-cavities 561" interfere with each other, with these regions of interference indicated schematically as "R1" in FIG. 5. Similarly, the diffracted light waves $W_{diff(\lambda i.x)}^{np}$ emanating from different ones of the nano-particles 563" also interfere with each other, with these regions of interference indicated schematically as "R2" in FIG. 5. The interference in regions "R1" of the diffracted waves $W_{diff(\lambda i.x)}^{n}$ results in localised increases in amplitude and intensity of light having a colour corresponding to wavelength $\lambda_{i.x}$. Similarly, the interference in regions "R2" of the diffracted waves $W_{diff(\lambda i.x)}^{np}$ results in localised increases in amplitude and intensity of light having a colour corresponding to wavelength $\lambda_{i.x}$. The amount of diffraction for a given wavelength component present in the incident light wave $W_i$ is a function of the size of the individual nano-cavities 561" and nano-particles 563". Further, the interference between different diffracted waves for a given wavelength and the resulting increase in amplitude and intensity is influenced by the spacing between adjacent ones of the nano-cavities 561" and the nano-particles 563". Where the predetermined wavelength $\lambda_{i.x}$ present in the incident light wave $W_i$ corresponds to or is close to (for example, within 50 nm) any of the one or more predetermined attenuation wavelengths of the window material 51, the interference of the diffracted light waves in regions R1 and R2 and corresponding increase in amplitude and intensity can help to offset any initial reduction in amplitude of the predetermined wavelength component $\lambda_{i.x}$ of the incident light wave $W_i$ caused by the attenuating effect of the window material 51.

Figure 6:
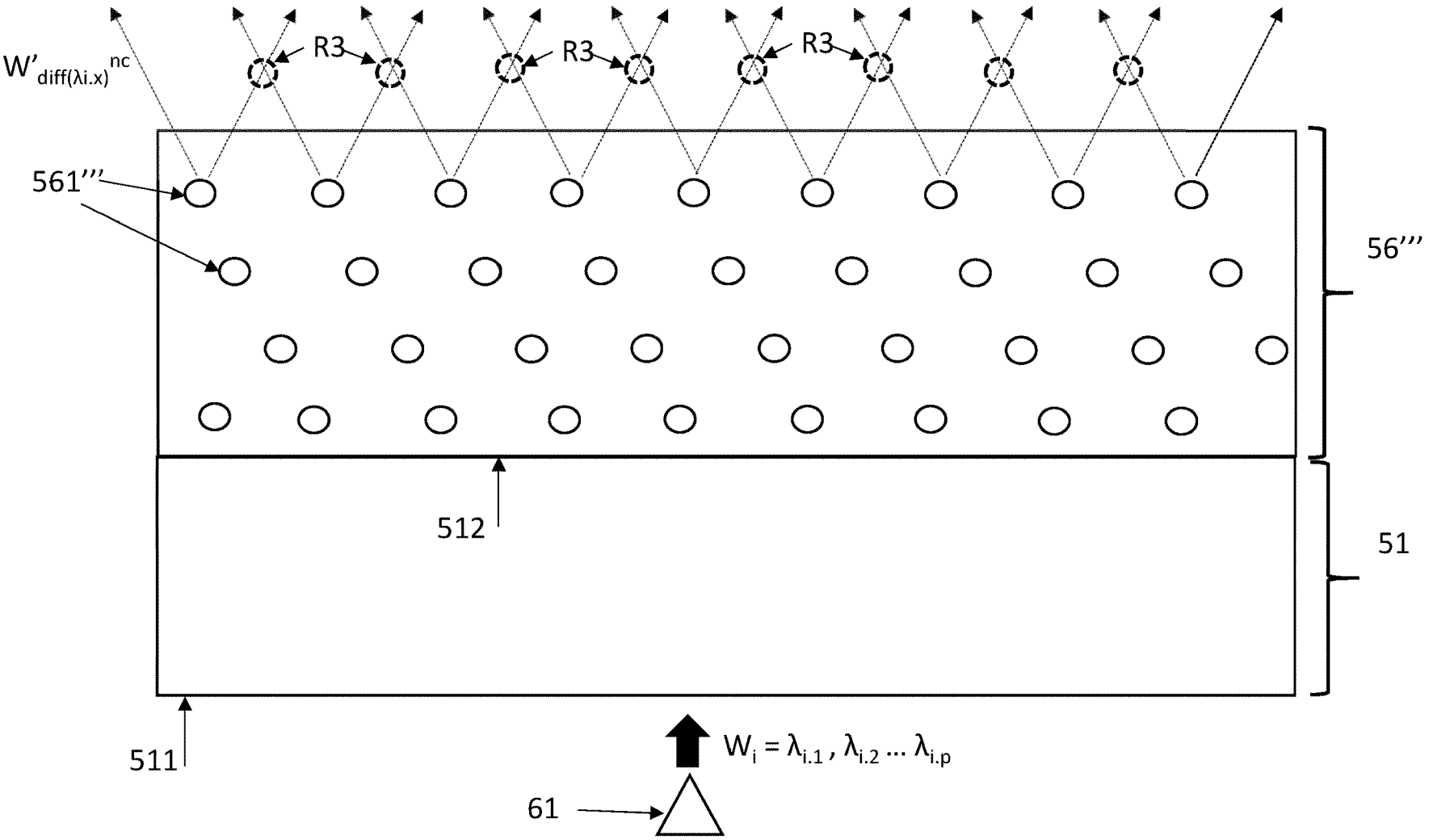
FIG. 6 shows a cross-sectional schematic view of a fourth embodiment of a display for use with the aerosol-generating device of FIG. 1.

FIG. 6 shows a schematic representation of a fourth embodiment of the layer of nano-photonic material 56" overlying the front-facing surface 512 of the window 51. The layer of nano-photonic material 56" is formed of a crystalline lattice of gallium nitride (GaN) defining a network of nano-cavities 561'''. The nano-cavities 561''' are spaced apart from each other in a predetermined pattern or repeating arrangement. In contrast to the embodiment of FIG. 5, no nano-particles are provided within the layer of nano-photonic material 56'''. The nano-cavities 561''' are each sized to have a diameter in a range of between 100 nm to 500 nm.

The behaviour of the nano-photonic material 56''' overlying the front-facing surface 512 of the notification window 51 for the embodiment of FIG. 6 is discussed in response to the window being backlit by a light wave generated by light source 61. The light source 61 is configured to generate incident light wave $W_i$, according to instructions provided by control circuitry provided on the printed circuit board 8. As for the embodiment shown and described in FIG. 5, the incident light wave $W_i$ has a wavelength composition which consisting of "p" constituent wavelengths $\lambda_{i.1}, \lambda_{i.2} \ldots \lambda_{i.p}$. In an alternative embodiment, the incident light wave $W_i$ may instead consist of a single wavelength.

When the light source 61 generates incident light wave $W_i$, the light wave first passes through the window 51 to fall incident on the layer of nano-photonic material 56'''. In a similar manner to the embodiment of FIG. 5, on entering the nano-photonic material 56''', the individual nano-cavities 561''' function like the slits of a diffraction grating to diffract the constituent wavelengths of the incident light wave $W_i$. The action of the individual nano-cavities 561''' in diffracting a specific predetermined wavelength $\lambda_{i.x}$ present in the incident light wave $W_i$ is discussed below with reference to FIG. 6. As the incident light wave $W_i$ passes through the nano-photonic material 56''', the nano-cavities 561''' diffract or deflect the constituent wavelengths present in the incident light wave. Different constituent wavelengths present in the incident light wave $W_i$ are diffracted by different amounts. The diffraction by nano-cavities 561''' of the predetermined wavelength component $\lambda_{i.x}$ present in the incident light wave $W_i$ into diffracted light waves $W'_{diff(\lambda i.x)}{}^{nc}$ is shown in FIG. 6. The diffracted light waves $W'_{diff(\lambda i.x)}{}^{nc}$ emanating from different ones of the nano-cavities 561''' interfere with each other, with these regions of interference indicated schematically as "R3" in FIG. 6. The interference in regions "R3" of the diffracted waves $W'_{diff(\lambda i.x)}{}^{nc}$ for wavelength $\lambda_{i.1}$ results in localised increases in amplitude and intensity of light having a colour corresponding to the wavelength $\lambda_{i.x}$. The amount of diffraction for a given wavelength component present in the incident light wave $W_i$ is a function of the size of the individual nano-cavities 561'''. Further, the interference in between different diffracted waves for a given wavelength and the resulting change in amplitude and intensity is influenced by the spacing between adjacent ones of the nano-cavities 561'''. Again, where the predetermined wavelength $\lambda_{i.x}$ present in the incident light wave $W_i$ corresponds to or is close to (for example, within 50 nm) of any of the one or more predetermined attenuation wavelengths of the window material 51, the interference of the diffracted light waves in regions R3 and corresponding increase in amplitude and intensity can help to offset any initial reduction in amplitude of the predetermined wavelength component $\lambda_{i.x}$ in the incident light wave $W_i$ caused by the attenuating effect of the window material.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number "A" is understood as "A"±10% of "A". Within this context, a number "A" may be considered to include numerical values that are within general standard error for the measurement of the property that the number "A" modifies. The number "A", in some instances as used in the appended claims, may deviate by the percentages enumerated above provided that the amount by which "A" deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-generating device, comprising:
a display;
a housing; and
a light source enclosed within the housing,
wherein the display comprises:
a notification window; and
a nano-photonic material extending over a front surface of the notification window,
the light source in optical communication with the notification window for backlighting the notification window with a light wave consisting of a single predetermined wavelength or wavelength composition to fall incident on the nano-photonic material, and
the nano-photonic material being configured to, in response to the light wave consisting of the single predetermined wavelength or wavelength composition backlighting the notification window and being incident on the nano-photonic material, increase an amplitude of the single predetermined wavelength or wavelength composition and emit therefrom a light wave comprising the single predetermined wavelength or wavelength composition with the increased amplitude.

2. The aerosol-generating device according to claim 1, wherein the nano-photonic material comprises a plurality of nano-structures, the nano-structures comprising either nano-cavities, nano-particles, or their combination, the nano-structures being arranged, sized, or formed to, in response to the light wave consisting of the single predetermined wavelength or wavelength composition backlighting the notification window and being incident on the nano-photonic material, increase the amplitude of the single predetermined wavelength or wavelength composition and emit therefrom the light wave comprising the single predetermined wavelength or wavelength composition with the increased amplitude.

3. The aerosol-generating device according to claim 2, wherein the plurality of nano-structures are arranged and sized to, in response to the light wave consisting of the single predetermined wavelength or wavelength composition backlighting the notification window and being incident on the nano-photonic material, diffract the incident light wave.

4. The aerosol-generating device according to claim 3, wherein the plurality of nano-structures comprise at least a first diffraction site and a second diffraction site, the first and the second diffraction sites being arranged and sized to each diffract the at least one single predetermined wavelength or wavelength composition of the incident light wave by a predetermined amount, such that the diffracted single predetermined wavelength or wavelength composition of light from the first diffraction site and the diffracted single predetermined wavelength or wavelength composition of light from the second diffraction site intersect with and reinforce each other.

5. The aerosol-generating device according to claim 2, wherein the nano-structures comprise nano-particles, and the nano-particles have a diameter in a range of between 9 nm to 120 nm.

6. The aerosol-generating device according to claim 2, wherein the nano-structures comprise nano-cavities, and the nano-cavities have a diameter in a range of between 100 nm to 500 nm.

7. The aerosol-generating device according to claim 1, wherein the nano-photonic material is comprised of a crystalline lattice defining a network of nano-cavities.

8. The aerosol-generating device according to claim 7, wherein individual nano-particles or clusters of nano-particles are provided in the crystalline lattice between the nano-cavities.

9. The aerosol-generating device according to claim 1, further comprising the light source in optical communication with the notification window and being configured to generate the light wave to backlight the notification window, the light wave comprising the single predetermined wavelength or wavelength composition.

10. The aerosol-generating device according to claim 1, wherein the display is a dead-front display in which the notification window comprises a material configured to attenuate light at one or more predetermined attenuation wavelengths, and wherein the single predetermined wavelength or wavelength composition is within 50 nm of the one or more predetermined attenuation wavelengths.

11. The aerosol-generating device according to claim 1, wherein the nano-photonic material is provided as a layer of nano-photonic material extending over the front surface of the notification window.

12. The aerosol-generating device according to claim 1, wherein the aerosol-generating device further comprises a heating element configured to apply heat to an aerosol-forming substrate located within the aerosol-generating device.

13. The aerosol-generating device according to claim 1, wherein a color of the notification window in response to the light source backlighting the notification window with a light wave provides a notification of a status of the aerosol-generating device.

14. The aerosol-generating device according to claim 1, wherein the aerosol-generating device is a smoking article configured to generate aerosol for inhalation by a user, or being configured to cooperate with a smoking article so as to induce the smoking article to generate aerosol for inhalation by a user.

* * * * *